US005449139A

United States Patent [19]

Herelier et al.

[11] Patent Number: 5,449,139

[45] Date of Patent: Sep. 12, 1995

[54] METHOD AND ASSEMBLY FOR FIXING SURFACE STABILIZING MESH, AND A HOLDING PIECE FOR THE FIXING ASSEMBLY

[75] Inventors: Patrick Herelier, St. Jean de Muzols, France; Joseph De Saedeleer, Dilbeek, Belgium

[73] Assignee: Societe de Prospection et D'Inventions Techniques (S.P.I.T.), Bourg-les-Valence, France

[21] Appl. No.: 234,518

[22] Filed: Apr. 28, 1994

Related U.S. Application Data

[63] Continuation of Ser. No. 910,801, Jul. 9, 1992, abandoned.

[51] Int. Cl.[6] ..... A47F 5/00

[52] U.S. Cl. ..... 248/300; 248/316.1; 248/547; 411/480

[58] Field of Search ..... 248/300, 316.1, 316.7, 248/56, 547, 546, 500, 505, 510; 211/100; 411/480, 485, 174, 175, 923, 482, 547, 546

[56] References Cited

U.S. PATENT DOCUMENTS

| | | | |
|---|---|---|---|
| 1,335,308 | 3/1920 | Wilson | 248/316.1 |
| 1,858,875 | 5/1932 | Blumenthal | 248/489 |
| 1,921,797 | 8/1933 | Armie . | |
| 2,365,785 | 12/1944 | Tinnerman | 248/56 |
| 2,931,603 | 4/1960 | Johnston et al. | 248/316.1 |
| 3,146,529 | 9/1964 | Chamberlin | 248/316.1 |
| 3,870,428 | 3/1975 | Jackson . | |
| 4,318,518 | 3/1982 | Davis . | |
| 4,533,102 | 8/1985 | Ferrell | 248/316.4 |
| 4,703,883 | 11/1987 | Losada | 248/547 |

FOREIGN PATENT DOCUMENTS

| | | |
|---|---|---|
| 2629147 | 3/1988 | France . |
| 193974 | 3/1923 | United Kingdom . |

OTHER PUBLICATIONS

Strassen und Tiefbau, vol. 43, No. 5, 1989.

*Primary Examiner*—Ramon O. Ramirez
*Assistant Examiner*—Korie H. Chan
*Attorney, Agent, or Firm*—Schwartz & Weinrieb

[57] ABSTRACT

Method and assembly for fixing a surfacing stabilising mesh and a piece for holding the fixing assembly. According to the method for fixing a mesh formed by interlaced strands (5) to a supporting material (3) after laying the mesh on the supporting material (3), the first wings (4) of the holding pieces with two wings (4, 6) are passed underneath the strands (5) of the mesh, the pieces being closed around the strands (5) and secured to the supporting material (3) by anchoring in the material (3), by means of an anchoring appliance, a single fixing component (2) for forming holding lugs (7) from the pieces (1) and securing the assembly to the supporting material (3).

18 Claims, 1 Drawing Sheet

METHOD AND ASSEMBLY FOR FIXING SURFACE STABILIZING MESH, AND A HOLDING PIECE FOR THE FIXING ASSEMBLY

This application is a continuation of application Ser. No. 07/910,801, filed Jul. 9, 1992 now abandoned.

FIELD OF THE INVENTION

The invention relates generally to the incorporation of a mesh in a road surface in order to decrease deformation of the road surface when in use and, more precisely, to a device for fixing the mesh to the ground.

BACKGROUND OF THE INVENTION

Several fixing methods are offered at the present time.

It is possible, using an anchoring appliance, to anchor in the ground fixing components with heads hanging apertures therein for the passage of a length of a steel wire, then to lay the mesh on the ground, pass lengths of wire through the heads of the fixing components and finally, using pliers, to twist or knot the ends of the lengths of wire around the strands, or rods, of the mesh. This method is long and tedious to implement, particularly in the stages in which the lengths of wire are inserted in the heads of the anchoring components and the ends of these lengths of wire are twisted together.

It is also possible to fix mesh rods to the ground by the fixing of brackets by means of anchoring components. If two anchoring components per bracket are used, it still takes a long time to secure the mesh, without mentioning the high consumption of anchoring components. If the brackets are fixed using only one anchoring component, on only one side of the rods, the latter, particularly through their own expansion and through that of the ground or the brackets themselves, may separate from the brackets resulting in a relative bulging of the mesh and therefore a certain amount of distortion of the road surface.

To make possible a better fixing to the ground of road surface stabilising meshes, it has already been proposed, for instance in the references FR-A-2 629 147 or StraBen und Tiefbau, vol. 43, No. 5, 1989, Sanierung von AsphaltstraBen mit Bewehrungseinlagen aus knotensteifen Kunstsoffgittern, Heerten et Horstman, a method for fixing, to a supporting material, a surfacing stabilising mesh, formed by interlacing strands, by the anchoring of fixing components in the supporting material by means of an anchoring appliance, wherein, after laying the mesh on the supporting material, holding pieces, which are closed around the strands and which are fixed to the supporting material by means of a single fixing component to form holding lugs secured to the supporting material, are passed underneath the strands of the mesh.

OBJECT OF THE INVENTION

The present invention aims at proposing a fixing method still more rapid and reliable.

SUMMARY OF THE INVENTION

The present invention relates, therefore, to a method of the last mentioned type, characterized in that a holding lug is formed and fixed to the supporting material in a single movement.

In the method of the invention, the formation of the holding lugs and their fixing to the supporting material are effected in the course of a single movement of an operator with the anchoring appliance, so that this fixing is effected overall in only two stages, the one in which the piece for forming the holding lug is passed underneath the given mesh strand and the one in which this lug is formed and secured.

Apart from surfacing stabilising meshes, the invention can also be applied to the fixing of any rod used in building and civil engineering such as, for example, a concrete core, and the invention therefore relates, more generally, to a method for fixing a rod to a supporting material, by anchoring fixing components in the supporting material by means of an anchoring appliance, wherein, after laying the rod on the supporting material, at least one holding piece, which is closed around the rod and which is fixed to the supporting material by means of a single fixing component to form a holding lug secured to the supporting material, is passed underneath the rod, characterized in that a holding lug is formed and fixed to the supporting material in a single movement.

The invention also relates to a holding piece for fixing, in accordance with the fixing method of the invention, a surfacing stabilising mesh or a rod to the supporting material, characterised by the fact that it has a first wing shaped to be passed underneath a mesh strand or the rod laid against the supporting material and a second wing arranged to receive a fixing component and be folded back onto the first wing and thus form a lug for holding the strand or rod.

The invention again relates to a fixing assembly incorporating the holding piece of the invention and a fixing component carried by the second wing of the holding piece and arranged for fixing the two wings to the supporting material.

It will be noted that the invention applies in reality to the fixing of a mesh to any supporting material, including a wall, the application to the stabilising of road surfaces having served only to define the original problem from which the invention arises.

BRIEF DESCRIPTION OF THE DRAWINGS

The invention will be understood better by means of the following description of several embodiments of the fixing assembly of invention, with reference to the accompanying drawings, in which like reference characters designate like or corresponding parts throughout the several views, and wherein.

DETAILED DESCRIPTION OF THE ILLUSTRATED EMBODIMENT

Figure 1:
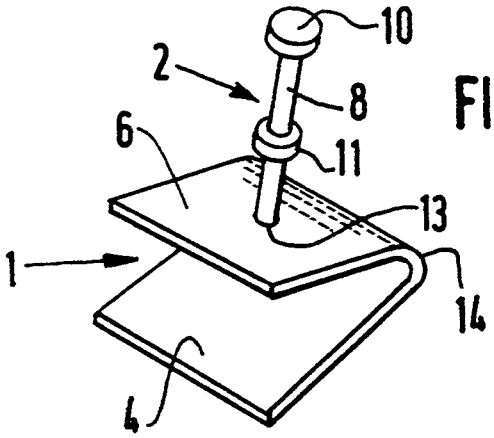
FIG. 1 is a perspective view of the fixing assembly with a first embodiment of the holding piece.

The fixing assembly, as shown in FIG. 1, has a holding piece 1 and a fixing component, or plug, 2 carried by the piece 1 and designed to secure the piece, after forming it into a holding lug, to a supporting material 3, in this case the earth of a road intended to receive a surfacing afterwards.

The piece 1 has a first wing 4, designed to be passed in this case under a mesh strand 5 and to bear against the ground 3 on which the mesh is laid, and a second wing 6, which carries the fixing component 2, designed to be folded back onto the first wing 4 to form the lug 7 for holding the strand 5 before the fixing component 2 is anchored in the ground in order to fix the two wings 4, 6.

In the example under consideration, the piece 1 is a strip of steel plate folded into a V, with the two wings 4, 6 connected by a rounded deformation zone 14.

The fixing component 2 has a cylindrical stem 8 provided, at one end, with a tapered part 9 or tip, and, at the other end, a widened part 10 or head. On the stem 8 of the fixing component 2 a retaining washer 11 is arranged, of the same external diameter as that of the head 10, for holding the fixing assembly within a self-contained anchoring appliance 12, which includes a means for propelling a weight under the action of combustion gases from a charge, all of which is perfectly conventional in the building and civil engineering field. After anchoring of the fixing component, the retaining washer 11 is interposed between the piece 1 and the head 10 of the fixing component 2.

The fixing component 2 is in this case held on the piece 1 by a slight deformation of the material forming second wing 6 created by forcible insertion into an orifice 13 previously made in the wing 6.

The angle between the two wings 4 and 6 of the piece 1 is preferably between 15 and 80 degrees. In any case it is such that it creates, between the bearing wing 4 and the tip 9 of the fixing component 2 a space permitting the mesh strand to be accommodated. As for the deformation zone 14, its internal radius is at the very most equal to the external radius of the mesh strand.

Figure 3:
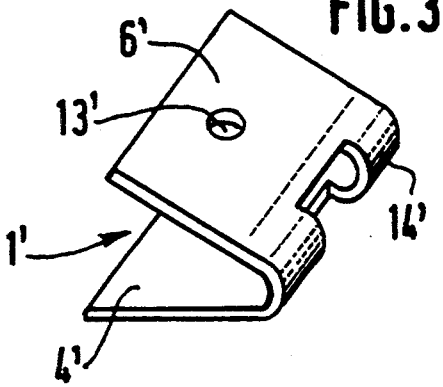
FIG. 3 is a perspective view of a second embodiment of the holding piece.

The embodiment of the holding piece 1' of FIG. 3 is distinguished from the piece 1 of FIG. 1 by a connection zone 14' between two wings 4' and 6' which has been weakened by the removal of a middle portion, to reduce the deformation force. In FIG. 3 the orifice 13' in the wing 6' for receiving a fixing component can be seen.

Figure 2:
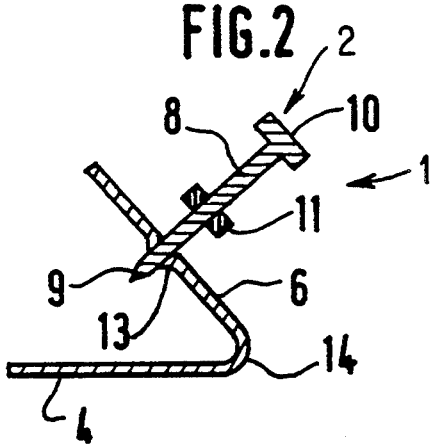
FIG. 2 is a cross-sectional view of the assembly of FIG. 1.
Figure 4:
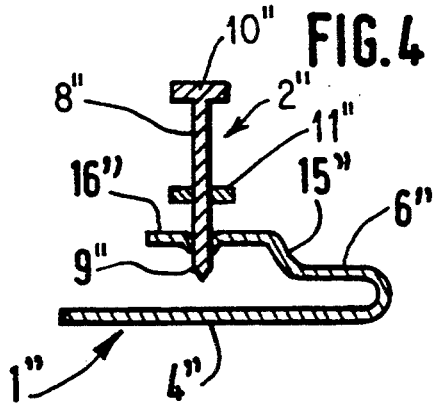
FIG. 4 is a cross-sectional view of the fixing assembly with a third embodiment of the holding piece.
Figure 6:
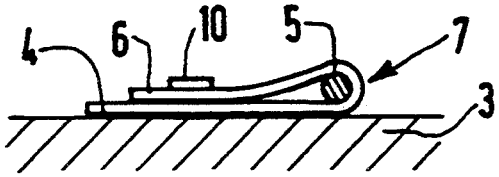
FIG. 6 is a side view of the fixing assembly of FIG. 1 once installed and fixed.

The embodiment of the holding piece 1'' of FIG. 4 is distinguished from those of FIGS. 1–3 by a folding of the strip of sheet metal not into a V but into a U, with two wings 4'' and 6'' parallel overall, and by a deformation of the wing 6'' for receiving the fixing component 2'' with an external shoulder 15'', for providing sufficient space between the bearing wing 4'' and the tip 9'' of the component 2 received in the portion 16'' of the wing 6'' which is furthest away from the bearing wing 4''.

Figure 5:
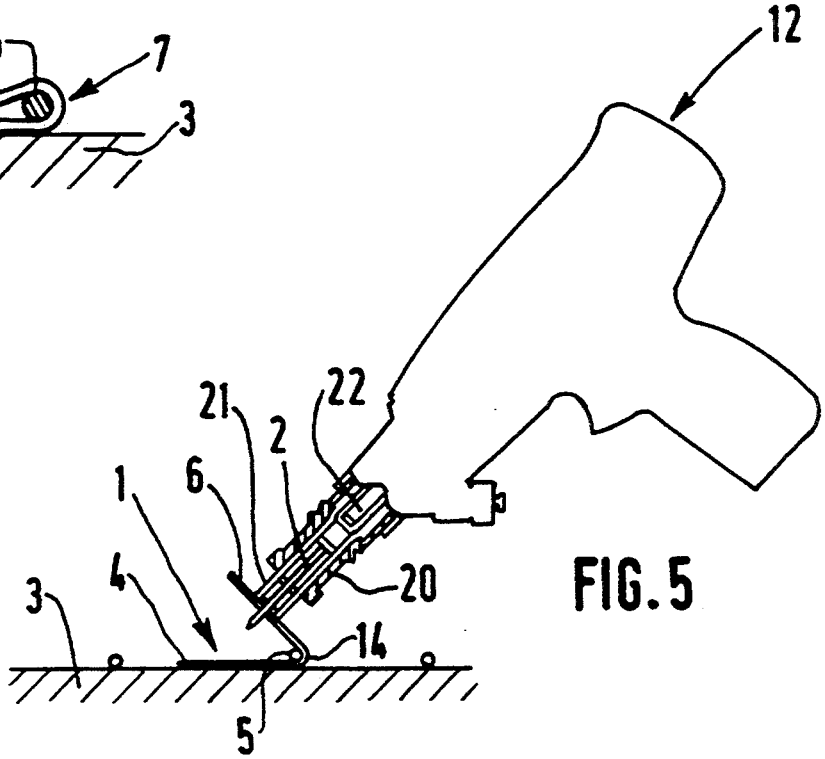
FIG. 5 is a side elevation view illustrating, on a smaller scale, the installation of the fixing assembly with an anchoring appliance.

For installing the fixing component 1 of FIG. 1, the same procedure is followed as with the other embodiments, and with reference to FIG. 5, a conventional anchoring appliance 12, shown here partially erased and in axial cross section, in order to show the gun-carrier 20, the plug guide 21 and the propulsion weight 22. The plug 2 is inserted into the plug guide until the wing 6 comes up against the plug guide 21. The wing 4 of the holding piece 1 is passed underneath the strand 5 of the mesh until the connecting zone 14 comes up against the strand 5 and the latter undergoes a light thrust. Using the appliance 12 as a lever, and practically in a single continuous movement, the wing 6 is caused to rotate about the strand 5 in order to fold it back on the wing 4. The piece 1 is closed on the strand 5, which is gripped in a holding lug. When it is substantially perpendicular to the surface of the receiving material 3, the appliance 12 is operated and the plug 2, under the action of the weight 22, is anchored in the supporting material 3 and fixes to it the two wings 4, 6 of the holding piece 1 in the form of a lug and, with it, the mesh strand 5 which is thus prevented from slipping out therefore.

As an anchoring appliance it is naturally preferable to use a weight appliance, but the invention is not limited to such a use. Other appliances or tools, preferably self-contained, can also be used perfectly well.

Obviously, many modifications and variations of the present invention are possible in light of the above teachings. It is therefore to be understood that within the scope of the appended claims, the present invention may be practiced otherwise than as specifically described herein.

We claim:

1. An assembly for fastening a member to a support substrate, comprising:

a holding piece comprising a first, imperforate wing member for engaging said support substrate; a second wing member disposed at a predetermined acute angle position with respect to said first wing member such that said second wing member is not parallel to said first wing member; and means interposed between said first and second wing members for integrally interconnecting said first and second wing members together at respective first end portions of said first and second wing members, respective second end portions of said first and second wing members being spaced from each other so as to define an opening between said first and second wing members through which said member, which is fastened to said support substrate, may be inserted such that said member, which is fastened to said support substrate, will be interposed between said first and second wing members within the vicinity of said means integrally interconnecting said first and second wing members together at said respective first end portions thereof when said member is fixedly fastened to said support substrate;

fastening means to be driven through said first and second wing members and into said support substrate for securing said holding piece, and said member, which is fastened to said support substrate, to said support substrate; and means defined solely between said fastening means and said second wing member fixedly retaining said fastening means solely within said second wing member, and a first end of said fastening means being in spaced relation with respect to said first wing member prior to driving said fastener means through said first and second wing members and into said support substrate, so as to permit said member, which is fastened to said support substrate, to be inserted into said opening defined between said first and second wing members and be disposed within said vicinity of said means integrally interconnecting said first and second wing members together at said respective first end portions thereof after said fastening means has been fixedly retained within said second wing member;

said means integrally interconnecting said first and second wing members together at said respective first end portions thereof being readily deformable so as to permit relative movement to occur between said first and second wing members such that when said fastening means is to be driven through said first and second wing members and into said support substrate, said second wing member can be moved from said acute angle position to a substantially parallel position with respect to said first wing member, and said fastening means being able to be driven through said second wing member from said initially fixedly retained position within said second wing member, through any portion of said first, imperforate wing member which will be disposed opposite said fastening means when said second wing member has been moved to said substantially parallel position with respect to said first wing member, and into said support substrate, in a substantially single movement, so as to permit said first and second wing members to engage each other and thereby close said opening defined between said respective second end portions of said first and second wing members whereby said holding piece fixedly envelops said member, which is fastened to said support substrate.

2. An assembly as set forth in claim 1, wherein:

said predetermined angle at which said second wing member is disposed with respect to said first wing member prior to driving said fastening means through said first and second wing members and into said support substrate is within the range of 15°–80°.

3. An assembly as set forth in claim 2, wherein:

said holding piece, comprising said first and second wing members disposed at said predetermined angle of between 15°–80° with respect to each other has a substantially V-shaped configuration.

4. An assembly as set forth in claim 1, wherein:

said means integrally interconnecting said first and second wing members comprises a deformable hinge portion for permitting said second wing member to be disposed in surface-to-surface contact with said first wing member when said fastening means is driven through said first and second wing members and into said support substrate.

5. An assembly as set forth in claim 1, wherein:

said means defined between said fastening means and said second wing member which fixedly retains said fastening means within said second wing member comprises an aperture pre-formed within said second wing member prior to insertion of said fastening means within said second wing member, annular wall means of said second wing member defining said aperture being deformed upon insertion of said fastening means within said aperture of said second wing member so as to define with said fastening means a friction-fit for fixedly retaining said fastening means within said second wing member.

6. An assembly as set forth in claim 1, wherein:

said holding piece has a longitudinal axis; and said means integrally interconnecting said first and second wing members comprises a pair of axially spaced, deformable hinge portions for permitting said second wing member to be disposed in surface-to-surface contact with said first wing member when said fastening means is driven through said first and second wing members and into said support substrate.

7. An assembly as set forth in claim 1, wherein:

said member to be fastened to said support substrate comprises a rod member.

8. An assembly as set forth in claim 1, wherein:

said member to be fastened to said support substrate comprises a rod-type strand portion of a stabilizing mesh to be anchored atop said support substrate.

9. An assembly as set forth in claim 1, wherein:

said second wing member comprises two substantially planar portions offset with respect to each other and integrally interconnected to each other by means of a shoulder portion such that one of said two planar portions is disposed further away from said first wing member than a second one of said two planar portions; and said fastening means is fixedly retained within said one of said two planar portions disposed further away from said first wing member so as to insure ease of passage of said member-to-be-secured-to-said-substrate through a space defined between said one of said two planar portions, having said fastening means fixedly retained therein, and said first wing member.

10. An assembly for fastening a member to a support substrate, comprising:

a holding piece comprising a first, imperforate wing member for engaging said support substrate; a second wing member disposed at a predetermined first angle position with respect to said first, imperforate wing member; and means interposed between said first and second wing members for integrally interconnecting said first and second wing members together at respective first end portions of said first and second wing members, respective second end portions of said first and second wing members being spaced from each other so as to define an opening between said first and second wing members through which said member, which is fastened to said support substrate, may be inserted such that said member which is fastened to said support substrate, may be interposed between said first and second wing members within the vicinity of said means integrally interconnecting said first and second wing members together at said respective first end portions thereof when said member is fixedly fastened to said support substrate;

fastening means to be driven through said first and second wing members and into said support substrate for securing said holding piece, and said member, which is fastened to said support substrate, to said support substrate; and aperture means defined solely within said second wing member engaging said fastening means so as to fixedly retain said fastening means solely within said second wing member in a pre-assembled state, and a first end of said fastening means being in spaced relation with respect to said first wing member prior to driving said fastening means through said first and second wing members and into said support substrate, so as to permit said member, which is fastened to said support substrate, to be inserted into said opening defined between said first and second wing members and be disposed within said vicinity of said means integrally interconnecting said first and second wing members together at said respective first end portions thereof after said fastening means has been fixedly retained within said second wing member in said pre-assembled state;

said means integrally interconnecting said first and second wing members together at said respective first end portions thereof being readily deformable so as to permit relative movement to occur between said first and second wing members such that when said fastening means is to be driven through said first and second wing members and into said support substrate, said second wing member can be moved from said first angle position to a second substantially parallel position with respect to said first wing member, and said fastening means is able to be readily driven through said aperture means of said second wing member from said initially fixedly retained pre-assembled state within said second wing member, through any portion of said first imperforate wing member which is disposed substantially opposite said aperture means of said second wing member when said second wing member has been moved to said substantially parallel position with respect to said first wing member, and into said support substrate, in a substantially single movement so as to permit said first and second wing members to engage each other in surface-to-surface contact and thereby close said opening defined between said respective second end portions of said first and second wing members whereby said holding piece fixedly envelops said member which is fastened to said support substrate.

11. An assembly as set forth in claim 10, wherein:

said holding piece comprising said first and second wing members has a substantially V-shaped configuration with said first and second wing members disposed at said predetermined angle with respect to each other which is within the range of 15°–80°.

12. An assembly as set forth in claim 10, wherein:

said holding piece comprising said first and second wing members has a substantially U-shaped configuration with said first and second wing members disposed at said predetermined first angle so as to be substantially parallel to each other.

13. An assembly as set forth in claim 12, wherein:

said second wing member comprises two substantially planar portions offset with respect to each other so as to be disposed within parallel planes and integrally interconnected to each other by means of a shoulder portion such that one of said two planar portions is disposed further away from said first wing member than a second one of said two planar portions; and said fastening means is fixedly retained within said one of said two planar portions disposed further away from said first wing member so as to insure ease of passage of said member-to-be-secured to-said-substrate through a space defined between said one of said two planar portions, having said fastening means fixedly retained therein, and said first wing member.

14. An assembly as set forth in claim 10, wherein:

said aperture means defined soley with in and said second wing member which fixedly retains said fastening means within said second wing member comprises an aperture pre-formed within said second wing member prior to insertion of said fastening means within said second wing member; and annular wall means of said second wing member, which define said aperture means, being deformed upon insertion of said fastening means within said aperture of said second wing member so as to define with said fastening means a friction-fit for fixedly retaining said fastening means within said second wing member.

15. An assembly as set forth in claim 10, wherein:

said means integrally interconnecting said first and second wing members comprises a deformable hinge portion for permitting said second wing member to be disposed in surface-to-surface contact with said first wing member when said fastening means is driven through said first and second wing members and into said support substrate.

16. An assembly as set forth in claim 10, wherein:

said holding piece has a longitudinal axis; and said means integrally interconnecting said first and second wing members comprises a pair of axially spaced, deformable hinge portions for permitting said second wing member to be disposed in surface-to-surface contact with said first wing member when said fastening means is driven through said first and second wing members and into said support substrate.

17. An assembly as set forth in claim 10, wherein:

said member to be fastened to said support substrate comprises a rod member.

18. An assembly as set forth in claims 10, wherein:

said member to be fastened to said support substrate comprises a rod-type strand portion of a stabilizing mesh to be anchored atop said support substrate.

* * * * *